US009895005B2

(12) United States Patent
Castilla

(10) Patent No.: US 9,895,005 B2
(45) Date of Patent: Feb. 20, 2018

(54) CONVERTIBLE CHILD SEAT

(71) Applicant: KIDS II, INC., Atlanta, GA (US)

(72) Inventor: Cesar Corral Castilla, Savannah, GA (US)

(73) Assignee: KIDS II, INC., Atlanta, GA (US)

( * ) Notice: Subject to any disclaimer, the term of this patent is extended or adjusted under 35 U.S.C. 154(b) by 21 days.

(21) Appl. No.: 14/716,639

(22) Filed: May 19, 2015

(65) Prior Publication Data

US 2015/0335170 A1 Nov. 26, 2015

Related U.S. Application Data

(60) Provisional application No. 62/001,274, filed on May 21, 2014.

(51) Int. Cl.

| | |
|---|---|
| ***A47C 13/00*** | (2006.01) |
| ***A47D 1/00*** | (2006.01) |
| ***A47D 9/00*** | (2006.01) |
| ***A47D 1/06*** | (2006.01) |
| ***A47D 5/00*** | (2006.01) |

(52) U.S. Cl.

CPC ..... *A47D 1/00* (2013.01); *A47D 1/002* (2013.01); *A47D 1/004* (2013.01); *A47D 1/008* (2013.01); *A47D 1/06* (2013.01); *A47D 5/00* (2013.01); *A47D 9/00* (2013.01)

(58) Field of Classification Search

CPC . A47D 1/00; A47D 9/00; A47D 1/004; A47D 1/008; A47D 1/002

USPC ..... 297/118, 119, 174 R, 134, 344.12, 297/354.12, 344.18, 440.1, 440.24, 447.2

See application file for complete search history.

(56) References Cited

U.S. PATENT DOCUMENTS

| | | | | |
|---|---|---|---|---|
| 4,856,809 | A | 8/1989 | Kohus et al. | |
| 5,165,755 | A * | 11/1992 | Rho | A47D 1/004 248/408 |
| 5,348,374 | A * | 9/1994 | Kuo | A47D 1/004 248/408 |
| 5,468,051 | A * | 11/1995 | Huang | A47D 1/004 248/125.3 |
| 5,489,138 | A | 2/1996 | Mariol et al. | |
| 5,564,778 | A | 10/1996 | Shimer et al. | |
| 5,806,922 | A * | 9/1998 | Mendelovich | A47D 1/004 297/119 |
| 5,855,384 | A | 1/1999 | Pike et al. | |
| 5,906,922 | A * | 5/1999 | Whittaker | A61K 47/48315 435/455 |
| 5,951,102 | A | 9/1999 | Poulson et al. | |
| 6,273,451 | B1 | 8/2001 | Julien et al. | |
| 6,478,327 | B1 | 11/2002 | Hartenstine et al. | |
| 6,626,451 | B1 | 9/2003 | Song | |

(Continued)

FOREIGN PATENT DOCUMENTS

| | | |
|---|---|---|
| EP | 2092857 A2 | 8/2009 |
| EP | 2572957 A2 | 3/2013 |

*Primary Examiner* — Chi Q Nguyen

(74) *Attorney, Agent, or Firm* — Gradner Groff Greenwald & Villanueva, PC

(57) ABSTRACT

A support device for children includes a base assembly comprising a frame, and a plurality of interchangeable support assemblies configured for removable attachment to the base assembly. The base assembly includes a first coupling element and each of the interchangeable support assemblies include a second coupling element for cooperative engagement with the first coupling element.

22 Claims, 5 Drawing Sheets

(56) References Cited

U.S. PATENT DOCUMENTS 6,666,473 B2 12/2003 Hartenstine et al.
6,666,505 B2 12/2003 Greger et al.
6,698,773 B2 3/2004 Hsia
6,910,708 B2 6/2005 Sack et al.
6,920,830 B1 7/2005 Asbach et al.
6,951,371 B2 10/2005 Wang
7,017,922 B2 3/2006 Hartenstine et al.
7,044,497 B2 5/2006 Hartenstine et al.
7,185,909 B2 3/2007 Espenshade et al.
7,188,858 B2 3/2007 Hartenstine et al.
7,229,083 B2 6/2007 Arai et al.
7,278,652 B2 10/2007 Riedl et al.
7,329,192 B2 * 2/2008 Gibree ..... A47D 13/105 472/119
7,374,196 B2 5/2008 Hartenstine et al.
7,404,569 B2 7/2008 Hartenstine et al.
7,410,185 B2 8/2008 Chen et al.
7,413,213 B2 8/2008 Pike et al.
7,490,558 B2 2/2009 Asbach et al.
7,523,954 B2 4/2009 Dotsey et al.
7,568,758 B2 8/2009 Troutman et al.
7,614,642 B2 11/2009 Dotsey et al.
7,651,168 B2 1/2010 Kelly
7,673,934 B2 3/2010 Bearup et al.
7,673,942 B2 3/2010 Tuckey et al.
7,686,322 B2 3/2010 Longenecker et al.
7,694,995 B2 4/2010 Dotsey et al.
7,770,911 B2 8/2010 Dotsey et al.
7,775,547 B2 8/2010 Dotsey et al.
7,845,671 B2 12/2010 Cone, II
7,862,054 B2 1/2011 Fiore, Jr.
7,871,100 B2 1/2011 Chen et al.
7,918,497 B2 4/2011 Keegan
7,971,897 B2 7/2011 Pike et al.
8,029,014 B2 10/2011 Ahnert et al.
8,056,921 B2 11/2011 Dotsey et al.
8,100,470 B1 * 1/2012 Hu ..... A47D 1/004 297/134
8,104,788 B2 1/2012 Cone, II
8,141,895 B2 3/2012 Haut et al.
8,162,390 B2 * 4/2012 Zhong ..... A47D 1/103 297/130
8,276,935 B2 10/2012 Minato et al.
8,322,744 B2 12/2012 Ahnert et al.
8,371,606 B2 2/2013 Gower et al.
8,376,461 B2 2/2013 Chen
8,398,098 B2 3/2013 Li
8,398,111 B2 3/2013 Mival et al.
8,419,025 B2 4/2013 Chen et al.
8,505,957 B2 8/2013 Bizzell et al.
8,550,556 B2 10/2013 Asbach
8,567,866 B2 10/2013 Carimati Di Carimate et al.
8,590,919 B2 11/2013 Yi
8,602,441 B2 12/2013 Li
8,602,442 B2 12/2013 Li
8,622,404 B2 1/2014 Chen et al.
8,651,572 B2 2/2014 Medeiros et al.
8,833,794 B2 9/2014 Yi
8,870,214 B2 10/2014 Kane et al.
8,919,806 B2 12/2014 Pollack et al.
8,936,267 B2 1/2015 Li et al.
8,950,761 B2 2/2015 Chen
8,955,868 B2 2/2015 Haut et al.
9,004,587 B2 4/2015 Winterhalter et al.
2003/0094791 A1 5/2003 Hartenstine et al.
2004/0090046 A1 5/2004 Hartenstine et al.
2006/0214397 A1 9/2006 Dotsey et al.
2007/0194614 A1 * 8/2007 Chen ..... A47D 1/002 297/344.18
2009/0033118 A1 2/2009 Gomez
2009/0127827 A1 5/2009 Pike et al.
2009/0160162 A1 6/2009 Bizzell et al.
2010/0127480 A1 5/2010 Ahnert et al.
2014/0077534 A1 * 3/2014 Stolarz ..... A47D 1/008 297/174 R
2015/0042130 A1 * 2/2015 Perrin ..... A47D 15/00 297/135

* cited by examiner

CONVERTIBLE CHILD SEAT

CROSS-REFERENCE TO RELATED APPLICATION

This application claims the benefit of U.S. Provisional Patent Application Ser. No. 62/001,274 filed May 21, 2014, the entirety of which is hereby incorporated herein by reference for all purposes.

TECHNICAL FIELD

The present invention relates generally to the field of support devices for children, and more particularly to a child's seat or high chair having interchangeable support assemblies allowing for convertibility of the device for multiple applications.

BACKGROUND

Children's support devices are well known in the industry. Support devices such as high chairs offer a secure resting place in which a caregiver can feed or entertain a child. Traditional high chair support devices include a seat that is fixedly coupled to a base, generally providing a single configuration for use, or a seat fixedly coupled to a height-adjustable base. These support devices are generally configured to be stationary, and receive only one child at a time in a specific upright position and/or serving specific or limited purposes.

Accordingly, it can be seen that needs exist for improvements in support devices to provide a plurality of functions and expanded utility in a variety of situations and applications, and with children of different sizes and development levels. It is to the provision of an improved children's support device meeting these and other needs that the present invention is primarily directed.

SUMMARY

In example embodiments, the present invention provides an improved children's support device, such as for example a child's seat or high chair, having a base and a reconfigurable support or seat assembly. In example embodiments, the reconfigurable support or seat assembly is detachably mounted to the base, and multiple different support or seat assemblies can be interchangeably mounted to the base to serve multiple different purposes and/or accommodate children of different ages, sizes or development levels.

In one aspect, the present invention relates to a support device for children. The support device preferably includes a base assembly comprising a frame, and a plurality of interchangeable support assemblies configured for removable attachment to the base assembly. The base assembly includes a first coupling element, and each of the plurality of interchangeable support assemblies include a second coupling element for cooperative engagement with the first coupling element.

In another aspect, the invention relates to a support device for children. The support device preferably includes a base assembly having a frame with a pair of front legs and a pair of back legs. The base assembly preferably also includes upper support members extending coaxially upward from each of the front legs. The base assembly preferably further includes a pair of base couplings. The support device preferably also includes a plurality of interchangeable support assemblies, each support assembly including a pair of support assembly couplings for releasable attachment to the base assembly couplings.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
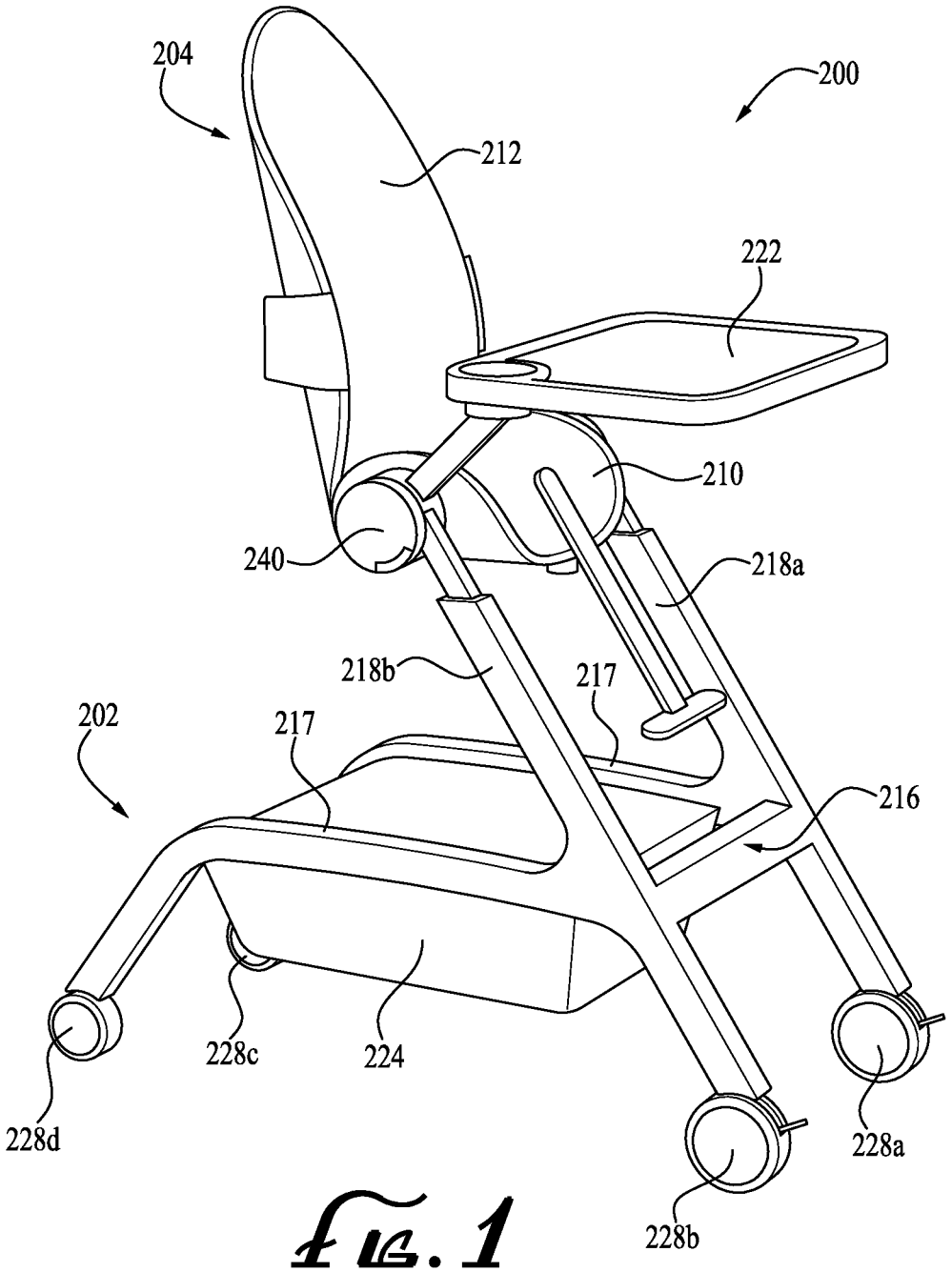
FIG. 1 is a first perspective view of a children's support device according to an example embodiment of the present invention.
Figure 2:
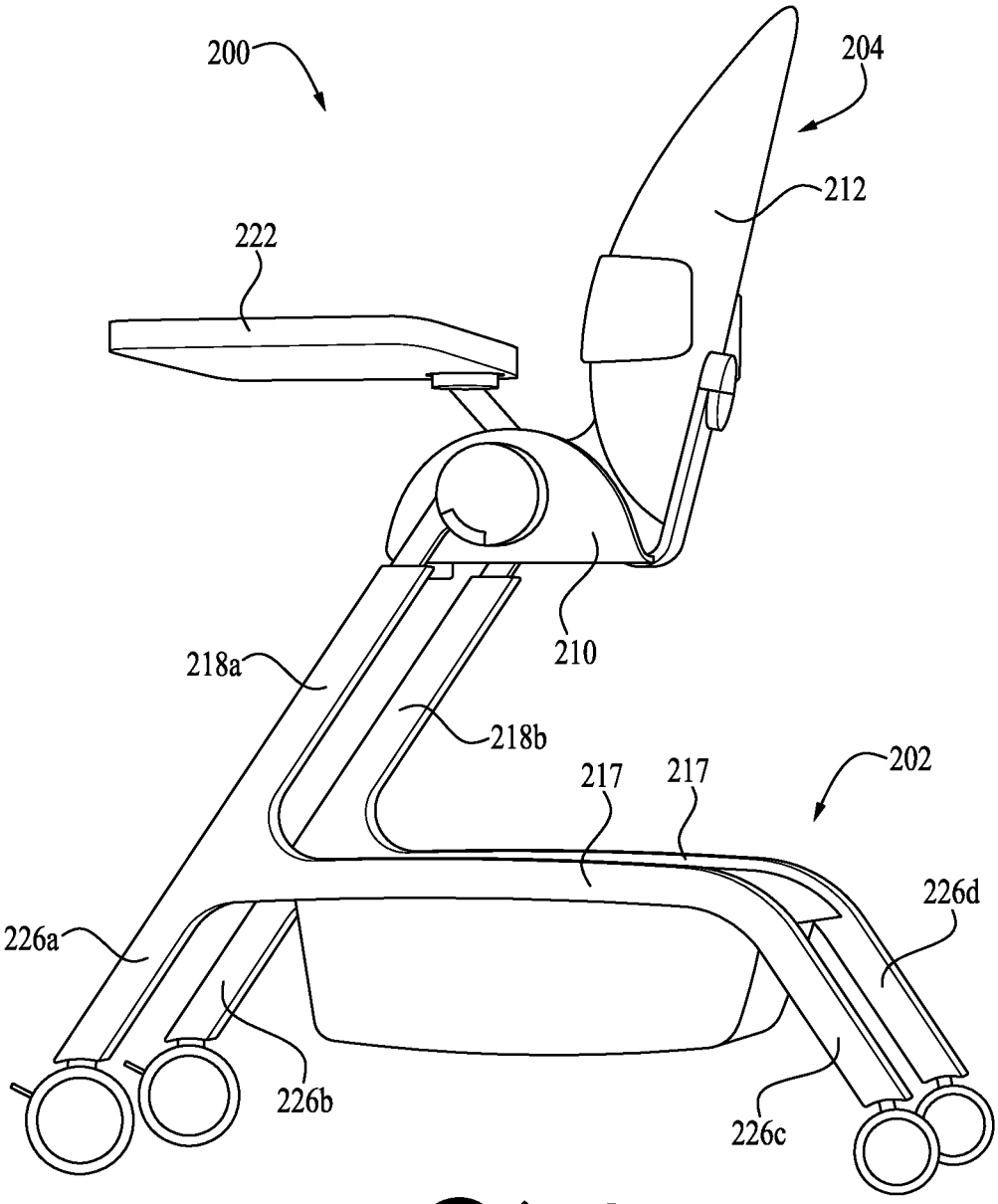
FIG. 2 is a second perspective view of the children's support device of FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value to the other particular value. Similarly, when values are expressed as approximations, by use of the antecedent "about," it will be understood that the particular value forms another embodiment.

The present invention relates to a support device for children, which is reconfigurable into a plurality of different configurations to serve multiple different functions and/or to accommodate children of different ages, sizes or development levels. In example forms, the support device generally comprises a seat or support assembly and a base assembly adapted to support the seat or support assembly at an elevated position above a floor or other support surface. In representative embodiments, the seat or support assembly is configured to receive and support at least one child.

Example configurations of the seat or support assembly comprise a chair type seat having a substantially vertical backrest portion coupled to and extending upwardly from a substantially horizontal seat portion. The seat assembly can further include a pair of arm support or armrest portions coupled to and extending upwardly or outwardly from opposite sides of the seat support portion or the backrest portion. The support device can optionally include a belt, harness, or other retention mechanism or means for retaining the child within the seat, and/or a crotch post, horn, or other mechanism for positioning the child in an upright seated position. The crotch post can be integrally formed with or coupled to said seat assembly or base assembly.

The base assembly is configured to support the seat assembly above a substantially horizontal support surface. In representative embodiments, the base assembly is constructed of a substantially rigid polymer such as polypropylene, a rigid metal, and/or any other structural supporting material(s). The base assembly can optionally be height-adjustable to allow a user to selectively vary the elevation of the seat or support assembly above the floor or surface upon which the base is positioned. For example, the base assembly can comprise one or more supports including a pair of telescoping tubular support members slidably engaged with one another and selectively positionable at a plurality of heights to effectively raise or lower the seat assembly. Optionally, the base assembly can include one or more castors, wheels or other rolling/sliding means to facilitate movement of the support device across a support surface.

The base and/or the support assembly can further comprise additional features and/or accessories. For example, a footrest configured to support the feet of a seated child can be provided. Moreover, various embodiments of the support device can include a tray mounted to the base and/or to the support assembly, and configured for supporting toys, bottles, food, and the like, and which can optionally also serve as a child restraint mechanism. The support device of the present Invention can be modular and reconfigurable for use in two or more modes. For example, the base assembly and seat assembly can be used in combination in a first high chair mode, the base assembly can operate independently in a toddler seat mode, and/or the seat assembly can operate independently in a booster seat mode. The child support device furthermore can be selectively converted to a non-high chair device, such as a chair/table combination or a rocker.

With reference now to the drawing figures, wherein like reference numbers represent corresponding parts throughout the several views, FIGS. 1-5 show an example embodiment of a support device 200 according to the present invention. The support device 200 comprises a base assembly or support structure 202 configured to rest on a floor or other support surface, and a seat or support assembly 204 configured for receiving and supporting a child in an elevated position. The seat assembly 204 of this embodiment comprises a chair-like support having a backrest portion 212, which is optionally pivotably and/or removably coupled to a substantially horizontal seat support portion 210. In example embodiments, the backrest recline adjustment comprises a one-button or single-actuator recline release mechanism.

Figure 3:
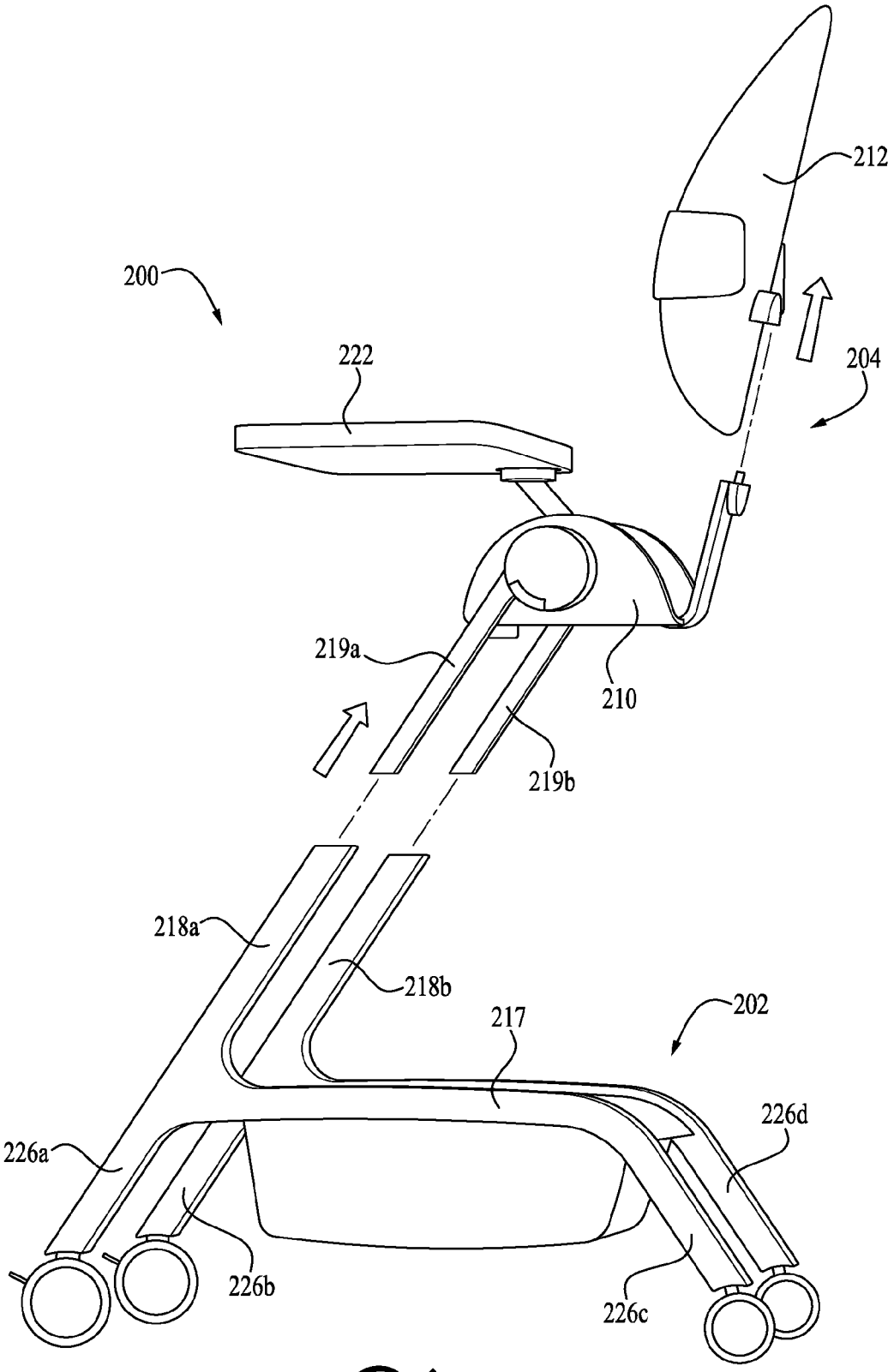
FIG. 3 is an assembly view of the children's support device of FIG. 1.

The base assembly or support structure 202 of the example embodiment comprises a base frame 216 comprising a pair of base frame members 217 extending generally horizontally and parallel to one another, with a plurality of legs 226*a*-226*d* descending therefrom, configured to rest on a support surface. One or more of the legs 226*a*-226*d* can optionally terminate in wheels or casters 228*a*-228*d*. The base assembly 202 further includes one or more substantially upright or angularly inclined upper frame members or upper support members 218*a*, 218*b* ascending from the base frame 216. The upper frame members 218*a*, 218*b* can optionally be selectively extendable and retractable, such that a caregiver can adjust the height of the support device 200. For example, height adjustment may be enabled by provision of telescopingly coupled upper extension arms 219*a*, 219*b* slidingly mounted to extend and retract relative to the upper frame members 218*a*, 218*b* as indicated in FIG. 3, and lockable in a selected height setting using a snap button spring lock or other conventional positional adjustment and locking mechanism. In example embodiments, a two-button or double-actuator height adjustment mechanism is provided. The support structure 202 can also optionally include a hinge or pivot mechanism that rotatably couples the upper frame members 218 to the base frame members 217, thereby permitting the support structure to be selectively folded into a collapsed or compact configuration for storage or transport.

In example embodiments, the base assembly 202 comprises a modified A-frame configuration, with the base frame members 217 being a substantially horizontal cross-member, and the legs 226*a*-226*d* tapering downwardly and outwardly away from the base frame to provide improved stability. In the depicted embodiment, the upper frame members 218*a*, 218*b* comprise substantially continuous and coaxial extensions of the front legs 226*a* and 226*b*, tapering upwardly and inwardly with their top ends spaced vertically above a medial portion of the base frame members 217. In this manner, the base 202 forms a generally equilateral triangular support structure with the seat supported in cantilevered fashion by the upper frame members 218*a*, 218*b*, and positioned generally at or proximal the apex of the triangular support structure at a point of intersection of the extended axes of the tapered legs 226*a*-226*d*, thus forming a structurally and aesthetically balanced assembly.

Figures 5A, 5B, 5C:
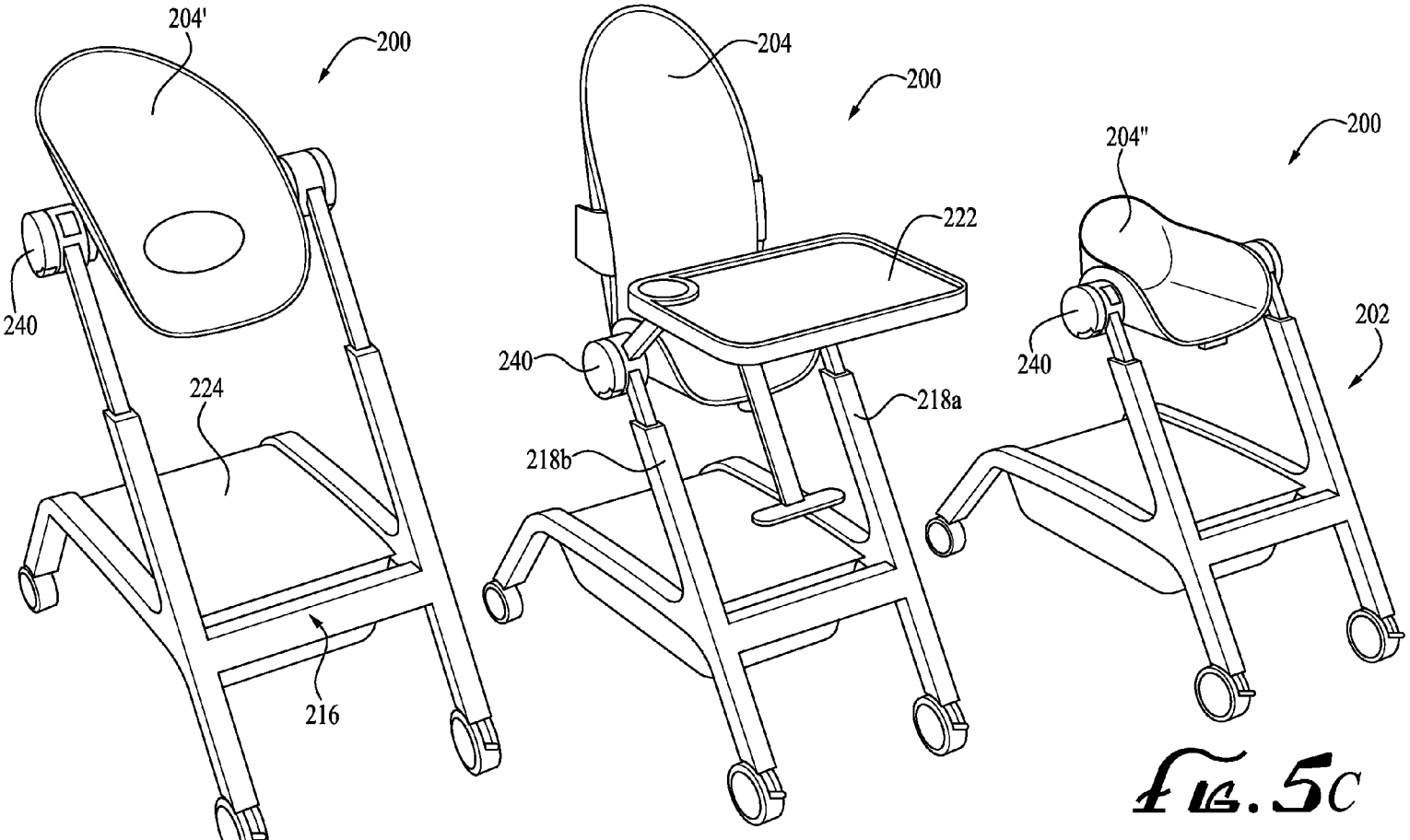
FIGS. 5A, 5B and 5C show alternative support assembly configurations of the children's support device of FIG. 1.

The seat assembly 204 can optionally also be reconfigured by repositioning the seat portion 210 and/or the backrest portion 212, by removal of one or the other of the portions of the seat assembly (FIG. 3), and/or by interchanging one or more portions of the seat assembly with seat or support components of different types, sizes or formats (FIGS. 5A, 5B and 5C). In this manner, the support device 200 is reconfigurable into a plurality of different configurations to serve multiple different functions and/or to accommodate children of different ages, sizes or development levels. For example, as shown in FIGS. 5A, 5B and 5C, the high chair-like seat assembly 204 (FIG. 5B) can be removed and interchangeably replaced with a cradle or baby station seat assembly 204' (FIG. 5A) for infants, a booster seat assembly 204" (FIG. 5C) for toddlers, and/or other seat assembly configurations adapted to different uses or applications, or to different ages or stages of development of the children using the support device 200.

The seat assemblies 204, 204', 204" can each comprise upper extension arms 219*a*, 219*b* extending therefrom and having a universal coupling profile for interchangeable engagement and removal from the upper frame members 218*a*, 218*b* of the base assembly 202; or alternatively, the upper extension arms can comprise part of the base assembly and the interchangeable seat assemblies can be attached to the base assembly by means of universal coupling hubs or receivers 240 affixed at the top ends of the upper extension arms. If provided, the coupling hubs 240 and the seat assemblies 204, 204', 204" respectively comprise first and second coupling elements that releasably engage one another to secure the seat 204 to the base 202, and allow ease of removal and interchangeability. The coupling hubs 240 optionally also comprise an angular positioning and retention mechanism allowing adjustment of the recline angle of the seat 204 relative to the base 202. In the depicted embodiment, when viewed from the side (FIG. 2), the coupling hubs 240 are positioned at or proximal to the apex or peak vertex of the generally equilateral frame triangle defined by the extended axes of the upper frame members 218*a*, 218*b* and the back legs 226*c* and 226*d*, and the front and rear caster wheels 228 are positioned at the lower or base vertices of the frame triangle.

Figure 4:
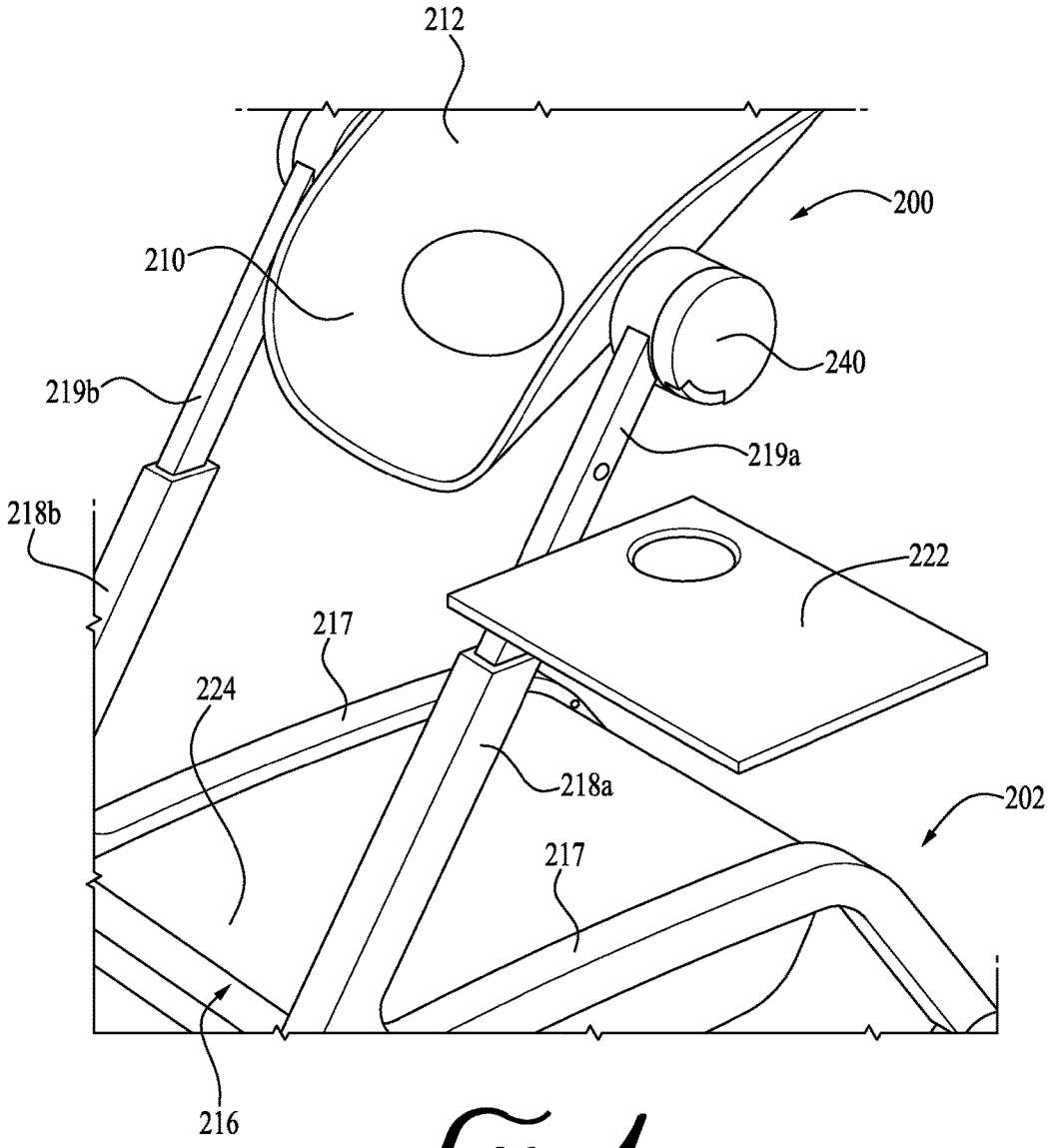
FIG. 4 is a close-up view of a side configuration of a reconfigurable tray component of the children's support device of FIG. 1.

In example forms, the seat assemblies 204, 204', 204" comprise a substantially rigid seat frame or substructure material with a flexible and resilient padded lining, and optionally a soft goods covering material that is removable for washing or replacement. For example, the seat assembly can comprise substantially rigid seat shell formed of plastic or a hard foam, a padded lining comprising foam, poly fill, or other conventional soft fill material, and a cover comprising vinyl or other easily cleanable material. The seat 204 or the frame 202 can optionally also comprise a footrest for supporting the feet of a child seated on the support device 200, which can optionally be removable and/or provide for adjustment of its position. The depicted example embodiment further comprises a tray 222 that can be positioned in one or more orientations, for example, in a laptop orientation as shown in FIG. 1, or a side orientation as shown in FIG. 4. The tray 222 can optionally be configured for attachment to the seat 204 and/or to the frame 202, and can be removable and/or repositionable thereon. The depicted example embodiment further comprises a storage compartment 224 coupled to the base assembly 202, optionally incorporating a cover or lid for opening or closing access to the storage compartment.

In an example method of use, a parent or caregiver selects a support assembly such as for example any of seats 204, 204', 204", and mounts the support assembly to the base assembly 202. The position of the support assembly may be adjusted by the caregiver, for example by raising or lowering its height, inclining or reclining its angle, or otherwise repositioning or reconfiguring the support assembly. A child is placed in the support assembly, and optionally secured by the straps or seat harness. If provided and used, the footrest and/or tray can be adjusted to the desired position, and items can be inserted and/or removed from the storage compartment as desired. The support device 200 may be used for various functions, such as for example a cradle, a baby station, a high chair, a changing table, a booster seat, or other functions. The support device 200 can preferably accommodate children of different ages, sizes or development levels, including for example, newborns or infants, toddlers and small children.

While the invention has been described with reference to preferred and example embodiments, it will be understood by those skilled in the art that a variety of modifications, additions and deletions are within the scope of the invention, as defined by the following claims.

What is claimed is:

1. A support device for children, comprising:

a base assembly comprising a frame; and a plurality of interchangeable support assemblies configured for removable attachment to the base assembly, wherein each of said plurality of interchangeable support assemblies are configured to support a child;

wherein the base assembly comprises a first coupling element and each of said plurality of interchangeable support assemblies comprise a second coupling element for cooperative engagement with the first coupling element; and wherein the frame of the base assembly comprises a base frame, a plurality of legs extending from the base frame, and at least one upper frame member extending from the base frame; and wherein the base frame comprises first and second base frame members extending generally horizontally and parallel to one another, and wherein each base frame member has a front leg extending downwardly from a front end thereof and a back leg extending downwardly from an opposite back end thereof, and wherein a first of the upper frame members extends upwardly from the front end of the first base frame member and a second of the upper frame members extends upwardly from the front end of the second base frame member.

2. The support device of claim 1, wherein the frame of the base assembly comprises a generally triangular modified A-frame configuration.

3. The support device of claim 2, further comprising wheels at lower ends of the front and back legs.

4. The support device of claim 3, wherein the triangular configuration of the frame defines a generally equilateral triangle with the wheels of the front and back legs defining base vertices of the triangle and with the first coupling element of the base assembly defining a peak vertex of the triangle.

5. The support device of claim 1, wherein the plurality of interchangeable support assemblies are selected from the group comprising a high-chair seat, a cradle and a booster.

6. The support device of claim 1, further comprising a tray.

7. The support device of claim 6, wherein the position of the tray is adjustable relative to a selected one of the plurality of interchangeable support assemblies that is mounted to the base assembly.

8. The support device of claim 1, further comprising a storage compartment mounted to the base assembly.

9. The support device of claim 1, further comprising a footrest coupled to at least one of the plurality of interchangeable support assemblies.

10. The support device of claim 1, wherein the first coupling element of the base assembly comprises at least one coupling hub.

11. A support device for children, comprising:

a base assembly comprising a frame; and a plurality of interchangeable support assemblies configured for removable attachment to the base assembly, wherein each of said plurality of interchangeable support assemblies are configured to support a child;

wherein the base assembly comprises a first coupling element and each of said plurality of interchangeable support assemblies comprise a second coupling element for cooperative engagement with the first coupling element; and wherein at least one of the plurality of interchangeable support assemblies comprises a recline angle adjustment.

12. A support device for children, comprising:

a base assembly comprising a frame; and a plurality of interchangeable support assemblies configured for removable attachment to the base assembly, wherein each of said plurality of interchangeable support assemblies are configured to support a child;

wherein the base assembly comprises a first coupling element and each of said plurality of interchangeable support assemblies comprise a second coupling element for cooperative engagement with the first coupling element; and wherein a height of the interchangeable support assemblies is adjustable.

13. A support device for children, comprising:

a base assembly comprising a frame; and a plurality of interchangeable support assemblies configured for removable attachment to the base assembly, wherein each of said plurality of interchangeable support assemblies are configured to support a child;

wherein the base assembly comprises a first coupling element and each of said plurality of interchangeable support assemblies comprise a second coupling element for cooperative engagement with the first coupling element; and wherein the first and second coupling elements comprise a pair of telescoping support members slidably engaged with one another and selectively positionable to raise or lower a selected one of the plurality of interchangeable support assemblies that is mounted to the base assembly.

14. A support device for children, comprising:

a base assembly comprising a frame having a pair of front legs and a pair of back legs, and upper support members extending coaxially upward from each of the front legs, the base assembly further comprising a pair of base couplings; and a plurality of interchangeable support assemblies, each support assembly comprising a pair of support assembly couplings for releasable attachment to the base assembly couplings, wherein each of said plurality of interchangeable support assemblies are configured to support a child;

wherein the base assembly comprises a height adjustment mechanism for selectively adjusting a support height of the support assembly, the height adjustment mechanism comprising a pair of telescoping support members slidably engaged with one another.

15. The support device of claim 14, wherein the plurality of interchangeable support assemblies are selected from the group comprising a high-chair seat, a cradle and a booster.

16. The support device of claim 14, wherein the frame forms a generally triangular support structure.

17. The support device of claim 16, wherein the support assembly, when attached to the base, is supported in cantilevered fashion by the upper support members above the generally triangular support structure.

18. The support device of claim 16, wherein the generally triangular support structure defines a generally equilateral triangle.

19. The support device of claim 14, wherein the base assembly couplings comprise coupling hubs mounted at top ends of the upper support members.

20. The support device of claim 19, wherein the coupling hubs comprise receivers for releasably engaging the support assembly couplings.

21. A support device for children, comprising:

a base assembly comprising a frame having a pair of front legs and a pair of back legs, and upper support members extending coaxially upward from each of the front legs, the base assembly further comprising a pair of base couplings; and a plurality of interchangeable support assemblies, each support assembly comprising a pair of support assembly couplings for releasable attachment to the base assembly couplings;

wherein the base assembly couplings comprise receivers in the upper support members, and the support assembly couplings comprise upper extension arms telescopingly mounted to extend and retract within the receivers of the upper support members.

22. A support device for children, comprising:

a base assembly comprising a frame having a pair of front legs and a pair of back legs, and upper support members extending coaxially upward from each of the front legs, the base assembly further comprising a pair of base couplings; and a plurality of interchangeable support assemblies, each support assembly comprising a pair of support assembly couplings for releasable attachment to the base assembly couplings, wherein each of said plurality of interchangeable support assemblies are configured to support a child;

wherein the base assembly couplings comprise receivers in the upper support members, and the support assembly couplings comprise upper extension arms telescopingly mounted to extend and retract within the receivers of the upper support members.

* * * * *